US006217497B1

(12) United States Patent
Laudenberg

(10) Patent No.: US 6,217,497 B1
(45) Date of Patent: Apr. 17, 2001

(54) STAND-UP APPARATUS FOR PRODUCING FLEXIBLE POUCHES

(75) Inventor: Bernd Laudenberg, Wipperfurth (DE)

(73) Assignee: Profile Packaging, Inc., Sarasota, FL (US)

( * ) Notice: Subject to any disclaimer, the term of this patent is extended or adjusted under 35 U.S.C. 154(b) by 0 days.

(21) Appl. No.: 09/433,902

(22) Filed: Nov. 9, 1999

Related U.S. Application Data

(60) Provisional application No. 60/107,626, filed on Nov. 9, 1998.

(51) Int. Cl.[7] ..... B31B 1/00; B31B 1/02

(52) U.S. Cl. ..... 493/11; 493/22; 493/194; 493/223; 493/340

(58) Field of Search ..... 493/11, 22, 194, 493/199, 223, 227, 340

(56) References Cited

U.S. PATENT DOCUMENTS

Re. 35,067 * 10/1995 Bauknecht ..... 493/11
5,518,559 * 5/1996 Saindon et al. ..... 156/64
5,777,879 * 7/1998 Sommerfeldt ..... 364/469.04
5,833,107 * 11/1998 Terranova et al. ..... 226/31
5,843,540 * 12/1998 Heydarpour et al. ..... 428/35.2

* cited by examiner

*Primary Examiner*—Peter Vo
*Assistant Examiner*—Hemant M. Desai
(74) *Attorney, Agent, or Firm*—Gifford, Krass, Groh, Sprinkle, Anderson & Citkowski, P.C.

(57) ABSTRACT

An apparatus for use in a form, fill, and seal packaging machine using preprinted web. The punch apparatus includes a registration sensor, a controller, a punch mechanism, a secondary servo feed drive and a dancer system. The registration sensor reads a registration mark on the web to send a signal to the controller which stops the secondary servo feed drive in a position one panel pitch downstream from the registration sensor. The punch is activated to punch holes along a cut line. The secondary feed drive is activated to advance the punched web to a dancer system. The web is moved from the dancer system to a conventional pouch forming machine by a primary feed drive.

3 Claims, 2 Drawing Sheets

STAND-UP APPARATUS FOR PRODUCING FLEXIBLE POUCHES

This application claims the benefit of U.S. Provisional Application No. 60/107,626, filed Nov. 9, 1998.

BACKGROUND OF THE INVENTION

I. Field of the Invention

The invention relates to an apparatus for producing flexible stand-up pouches and, in particular, an apparatus for punching holes in a web during production of the pouch.

II. Description of the Prior Art

It is well known to produce flexible pouches from a continuous web of plastic film. The web is preprinted with the label and product information. A registration eyemark is formed along one edge of the web for each preprinted panel. The web is fed to a knife cutter. A sensor such as an electronic eye is used to detect the registration mark and generate a signal to stop the web and initiate the knife cutter to cut a panel from the web. Fitments are then attached to the panel and the pouch is formed by sealing the edges.

When a stand-up style pouch is being produced, a pair of holes are punched in the web in order to facilitate forming the welding of the base of the stand-up pouch. These holes permit welding of the corners of the leading and trailing edges of the pouch to the base to form gussets on the sides. The holes are punched in the web by a die cutter before the web moves to the knife cutter to form the panels. The die cutter is positioned upstream of the knife cutter and is activated to punch the holes when the web is stopped downstream at the cutting station.

However, the length between the registration marks on the web or pitch is not always equal due to shrinkage or stretch during the printing of the web. The length of each pitch or panel can vary as much as +/−0.0625 inches per pouch. The result of this variability in length can cause a variety of hole punching problems when the holes are punched upstream of the cutoff knife. As an example, if the stand-up hole punches are 20 pitches upstream of the cutoff knife and the variability of the web is +/−0.0625 inches, the hole punch could be theoretically +/−(20)*0.0625 inches or +/−1.25 inches off. The position of the hole punch must be manually adjusted whenever the web material has a length variation, a splice, or if there is a roll change. This results in a great slow down in the process.

Accordingly, it would be advantageous to automatically adjust the position of the die cutter to punch the holes in the proper position.

SUMMARY OF THE PRESENT INVENTION

The present system compensates for variations in the web length and automatically positions the web for punching stand up holes. The system utilizes a secondary or die punch registration eye. The die punch eye is positioned a distance of one pitch or panel width upstream of the stand-up hole punch. When the eyemark is detected, a servo powered secondary or die punch feed drive immediately stops the web. The web is thus aligned in exactly the correct position for proper hole punch alignment.

A dancer system is positioned downstream of the die punch feed drive. After the die punch punches the holes, the die punch feed drive is activated to move the web into the die punch dancer system. The dancer system accumulates the web and maintains a constant tension on the web until it is moved downstream by the primary web drive.

The present invention permits the punch system to operate independently from the main web feed roll system without running any risk of either breaking the web because of too much tension or having too much slack in the system thus causing operating problems.

This system precisely punches the stand-up holes in the proper location regardless of variability in the printing of the web, a splice, or when a new roll is put through the machine.

BRIEF DESCRIPTION OF THE DRAWINGS

The apparatus and features of the invention depicted in the accompanying drawing which form a portion of the disclosure and wherein like reference numerals are used for like elements and wherein.

DESCRIPTION OF THE PREFERRED EMBODIMENTS OF THE INVENTION

Figures 1, 2:
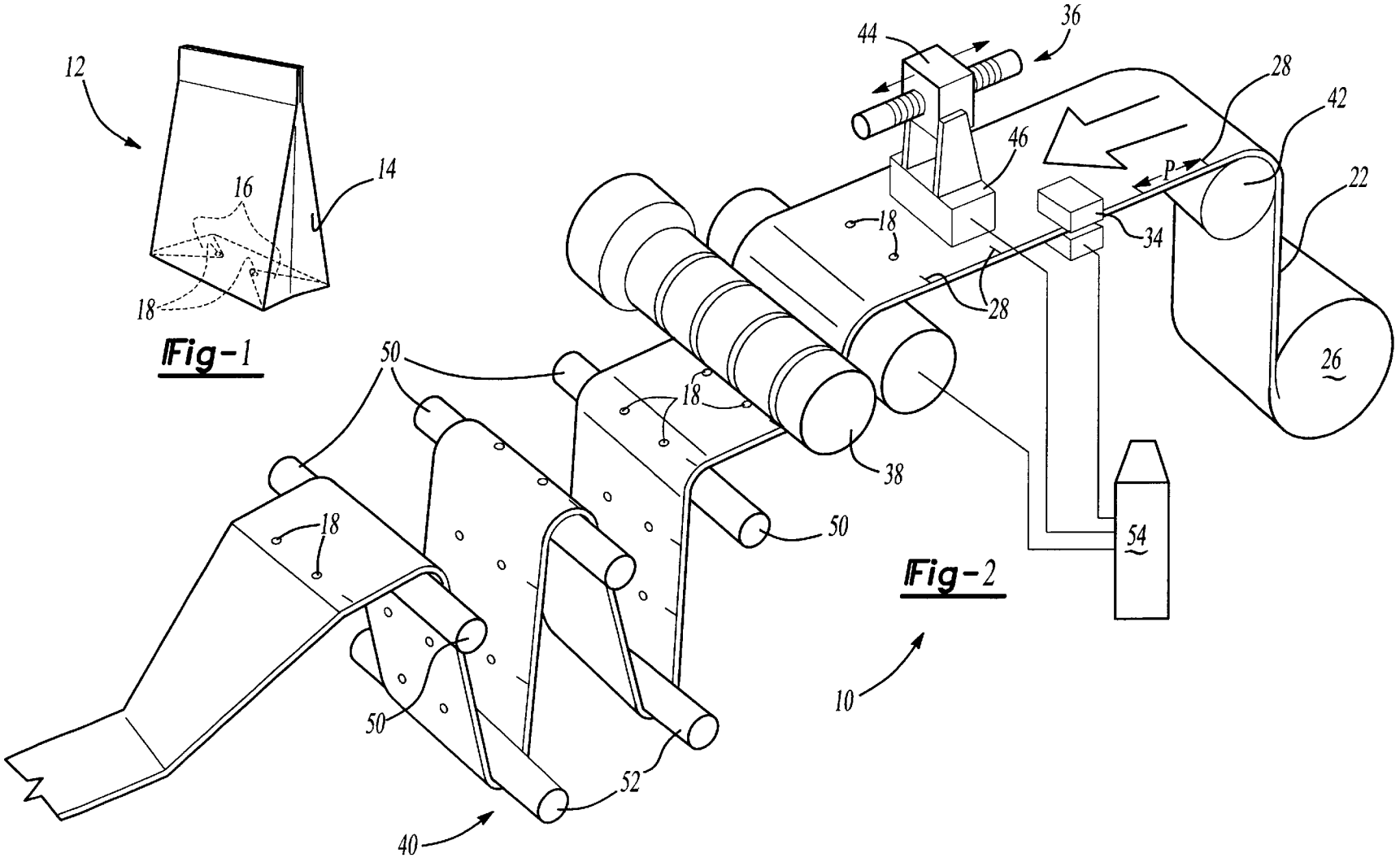
FIG. 1 is a perspective view of a stand-up pouch formed in accordance with the invention.
FIG. 2 is a perspective view partly broken away showing a die punch apparatus for use in forming flexible stand-up pouches in accordance with the invention.

An automatic punching apparatus 10 for use in producing a stand-up flexible pouch in accordance with the invention is shown in FIG. 2. The apparatus 10 is used for forming a stand-up flexible pouch 12 of the type shown in FIG. 1. The pouch has side gussets 14 formed when comers 16 of the pouch are folded inwardly and heat welded to a bottom panel. The welding process is improved by cutting a pair of access holes 18 through the bottom panel. The holes 18 permit the heat from a heat sealer (not shown) to pass through the holes to reach the folded corners 16 for welding.

Figure 3:
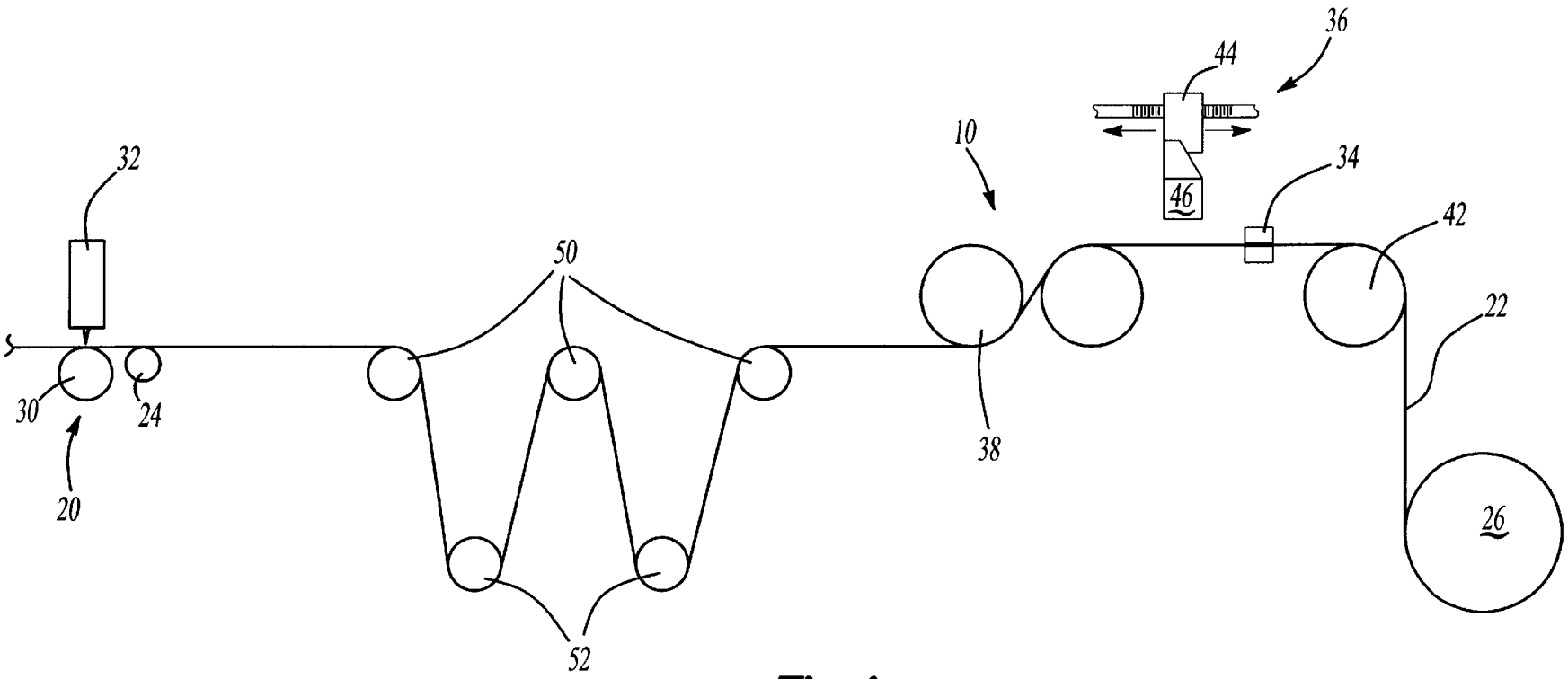
FIG. 3 is a schematic of a pouch forming machine with punching apparatus in accordance with the invention.

The punching apparatus 10 is suitable for use on virtually any type of pouch making machine, such as the horizontal form, fill and seal machine 20 by Laudenberg of Whipplefurth, Germany, and shown in FIG. 3. The machine 20 is of a type which produces flexible bags or pouches 12 in a continuous operation from a web 22 of plastic film. The web is fed through the machine by a primary drive unit 24 from a spool 26 which has been preprinted in panels. A registration eyemark 28 is positioned along one edge of the web 22 of each panel. The separation between eyemarks 28 is one pitch "p", which is equivalent to the panel length. The registration mark 28 is placed to indicate the cut line which separates the top of one panel from the bottom of another panel. The machine 20 has a cutting station with an electronic eye 30 positioned to detect the position of the registration eyemark 28 and activate a knife cutter 32 to separate a panel from the web 22.

The punching apparatus 10 in accordance with the invention is shown in FIGS. 2 and 3. The punching apparatus includes a punch eyemark sensor 34, a hole punch 36, a servo powered secondary or punch drive 38, and a secondary or punch dancer system 40. The punching apparatus 10 is positioned upstream of the knife cutter 32 and downstream of the spool 26 from which the web 22 is unwound. The web 22 is delivered to the apparatus over a roller 42 and passes sequentially beneath the eyemark sensor 34 and punch mechanism 36 to the servo powered punch feed drive 38. The registration sensor 34 may be of any suitable type and is positioned to read the registration mark 28 upstream of the punch mechanism 36. The punch mechanism 36 may include a positioning mechanism 44 and a die cutter 46. The positioning mechanism 44 adjusts the position of the die cutler 46 along the web with respect to the eyemark sensor 34. The positioning mechanism 44 may be of any suitable type, such as a servo controlled feed screw. In the preferred embodiment, the die cutter 46 is positioned to be a distance one pitch "p" downstream of the registration eye 34. The punch feed drive is servo powered to precisely position the web and operates independently of the main feed drive 24.

The punch dancer system 40 is positioned downstream of the punch feed drive 38 to receive the web 22 from the feed drive 38 once the punch has been completed and the feed drive 38 is reactivated. The dancer system 40 permits the main feed drive to run independently of the punching operation and to take the web 22 from the dancer system 40 when the punch feed drive 38 is stopped for the punching operation. The dancer system 40 is conventional and includes three rollers 50 which are supported in position and two vertically movable rollers 52. The movable rollers 52 are guided to move downwardly to place tension on the web 22 which is fed into the dancer system 40. When the main feed drive 24 is activated, the web 22 is pulled from the dancer system 40 and the movable rollers 52 are permitted to move upwardly, keeping tension on the web 22 at all times but permitting the web to be drawn to the cutting station.

OPERATION

The registration sensor 34, punch mechanism 36, and punch feed drive 38 are connected to a controller 54 or a CPU. The distance between the die cutter 46 and registration sensor 34 is set to be equal to the pitch. The positioning mechanism 44 is used to position the die cutter. After the position is determined, the die cutter 46 remains in the same position with respect to the eyemark sensor 34 and is only changed for making packages having a different panel size. When the eyemark sensor 34 detects a registration mark 28, it sends a signal to a controller 54 which immediately sends a signal to stop the punch feed drive 38, stopping the web 22 beneath the die cutter. The controller 54 then activates the die cutter 46 to punch the holes 18. After the hole cutting is complete, the feed drive 38 is activated to move the web 22 to the dancer 40 and repeat the cycle. The punched web is moved by the primary feed drive 24 to the cutting station.

It is understood that while certain embodiments of the present invention have been illustrated and described, it is not limited to specific forms of arrangements herein described and shown.

What is claimed is:

1. An apparatus for forming a plurality of flexible pouches from a web having a plurality of spaced apart registration marks, each pouch having a predetermined panel length of one pitch, said apparatus for use with a machine having a primary feed drive and a cutting station, said apparatus comprising:

a controller;

a punch mechanism for punching holes in said web, said punch mechanism receiving a signal from said controller;

a registration mark sensor adapted to read one of said plurality of registration marks and send a signal to said controller, said sensor spaced a distance of one pitch upstream from said punch mechanism;

a positioning mechanism for selectively positioning said punch mechanism to and away from said sensor; and a secondary feed drive positioned upstream of said primary feed drive, said controller stopping said secondary feed drive when said sensor detects a registration mark.

2. The apparatus of claim 1, further comprising a dancer system disposed downstream of said secondary feed drive to receive said web.

3. A method of forming a stand-up pouch, said method comprising:

forming a web having a plurality of registration marks spaced a predetermined distance apart;

positioning a punch one pitch length downstream from a registration sensor;

feeding said web to a registration sensor;

stopping the web when one of said plurality of registration marks is sensed;

activating said punch to form at least one hole in said web;

advancing said web to a dancer system;

feeding said web to a cutting station having a cutter from said dancer system;

activating said cutter to cut a panel with said at least one hole from said web; and forming said pouch from said panel.

* * * * *